US005664652A

United States Patent [19]

Shamah

[11] Patent Number: 5,664,652

[45] Date of Patent: Sep. 9, 1997

[54] VETICALLY EXPANDABLE LUGGAGE WITH INTEGRAL WHEELED CARRIER

[75] Inventor: Edward Shamah, Brooklyn, N.Y.

[73] Assignee: Romar International Corp., New York, N.Y.

[21] Appl. No.: 721,616

[22] Filed: Sep. 26, 1996

[51] Int. Cl.[6] ..... A45C 5/14; A45C 7/00; A45C 13/26; A45C 13/38

[52] U.S. Cl. ..... 190/18 A; 190/15.1; 190/39; 190/103; 190/105; 190/115

[58] Field of Search ..... 190/18 A, 15.1, 190/39, 103–105, 107, 115, 122, 125, 127; 383/2

[56] References Cited

U.S. PATENT DOCUMENTS

| | | | |
|---|---|---|---|
| 2,729,257 | 1/1956 | Kepper | 383/2 |
| 3,443,671 | 5/1969 | Dyke | 190/103 |
| 3,746,066 | 7/1973 | McIntyre | 383/97 X |
| 3,934,895 | 1/1976 | Fox | 190/18 A X |
| 4,361,215 | 11/1982 | Sawai | 190/103 X |
| 4,618,035 | 10/1986 | Mao | 190/18 A |
| 4,733,759 | 3/1988 | Shih-Chen | 190/103 |
| 5,038,842 | 8/1991 | Huang | 190/105 X |
| 5,060,795 | 10/1991 | Bomes et al. | 190/103 X |
| 5,374,073 | 12/1994 | Hung-Hsin | 190/18 A X |
| 5,586,628 | 12/1996 | Wang | 190/39 X |

FOREIGN PATENT DOCUMENTS

| | | | |
|---|---|---|---|
| 303594 | 1/1929 | United Kingdom | 190/115 |
| 2245250 | 1/1992 | United Kingdom | 190/18 A |

*Primary Examiner*—Sue A. Weaver
*Attorney, Agent, or Firm*—Amster, Rothstein & Ebenstein

[57] ABSTRACT

Vertically expandable luggage having an integral wheeled carrier therefor has a vertically expandable luggage sidewall including at least three vertically stacked shells defining: (i) a bottom shell with a closed bottom, (ii) a top shell with an openable closed top, and (iii) at least one vertically stacked intermediate shell connecting the top shell and the bottom shell. At least one intermediate shell is movable between a vertically collapsed orientation and a vertically expanded orientation. A vertically expandable wheeled carrier includes at least three vertically stacked supports defining: (i) a bottom support of diameter D3, (ii) a top support of diameter D1, and (iii) a vertically stacked intermediate support of diameter D2 functionally connecting the top support and the bottom support. The intermediate support telescopically receives the top support and is telescopically received in the bottom support. The top support is telescopically extendable from or receivable within the intermediate support without movement therewith of the luggage sidewall. A top portion of the intermediate support is secured to the top shell for vertical movement therewith, and a top portion of the bottom support is secured to the bottom shell for vertical movement therewith.

8 Claims, 4 Drawing Sheets

VETICALLY EXPANDABLE LUGGAGE WITH INTEGRAL WHEELED CARRIER

BACKGROUND OF THE INVENTION

The present invention relates to vertically expandable luggage and, more particularly, to vertically expandable luggage having an integral wheeled carrier therefor.

Vertically expandable luggage is well known in the luggage art and preferred by many users for its ability to adjust in height to meet the luggage requirements of the user at a given time. The popularity of vertically expandable luggage has been limited by the fact that the expansion feature allows for a large amount of luggage to be contained in the luggage, but that extended amount of baggage is then too heavy to be comfortably carried by hand. Worse yet, the expandable luggage does not lend itself well to the incorporation of a wheeled carrier therefor. This is a serious commercial disadvantage as much of the luggage currently being sold includes some form of an integral wheeled carrier to facilitate the user moving the luggage without any help from a porter or the like and without the need to repeatedly attach or detach the carrier and luggage.

Accordingly, it is an object of the present invention to provide vertically expandable luggage which includes an integral wheeled carrier therefor.

Another object is to provide such luggage wherein the carrier is vertically expandable.

A further object is to provide such luggage wherein the vertical height of the carrier is adjustable to match the vertical height of the luggage sidewall.

It is another object of the present invention to provide such luggage which is inexpensive and easy to use.

SUMMARY OF THE INVENTION

It has now been found that the above and related objects of the present invention are obtained in vertically expandable luggage including an integral vertically expandable wheeled carrier therefor. The luggage comprises a vertically expandable luggage sidewall including at least three vertically stacked shells defining: (i) a bottom shell with a closed bottom, (ii) a top shell with an openable closed top, and (iii) at least one vertically stacked intermediate shell connecting the top shell and the bottom shell. At least one intermediate shell is movable between a vertically collapsed orientation and a vertically expanded orientation. A vertically expandable wheeled carrier includes at least three vertically stacked supports defining: (i) a bottom support of diameter D3, (ii) a top support of diameter D1, and (iii) a vertically stacked intermediate support of diameter D2 functionally connecting the top support and the bottom support. The intermediate support telescopically receives the top support and is telescopically received in the bottom support. The top support is telescopically extendable from or receivable within the intermediate support without movement therewith of the luggage sidewall. A top portion of the intermediate support is secured to the top shell for vertical movement therewith, and a top portion of the bottom support is secured to the bottom shell for vertical movement therewith.

In a preferred embodiment, relative telescopic displacement of the intermediate support and the bottom support is related to relative displacement of the top shell and the bottom shell, but relative telescopic displacement of the top support and the intermediate support is not related to relative displacement of the top shell and the bottom shell.

The luggage preferably additionally includes top raceway connecting means about and connecting the top support and the intermediate support, and bottom raceway connecting means about and connecting the intermediate support and the bottom support. Top locking means are associated with the top raceway connecting means for releasably precluding relative vertical movement of the top support and the intermediate support, and bottom locking means are associated with the bottom raceway connecting means for releasably precluding relative vertical movement of the intermediate support and the bottom support.

Preferably D2 is greater than D1 and less than D3, and there are at least two vertically stacked intermediate shells.

BRIEF DESCRIPTION OF THE DRAWING

The above and related objects, features, and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
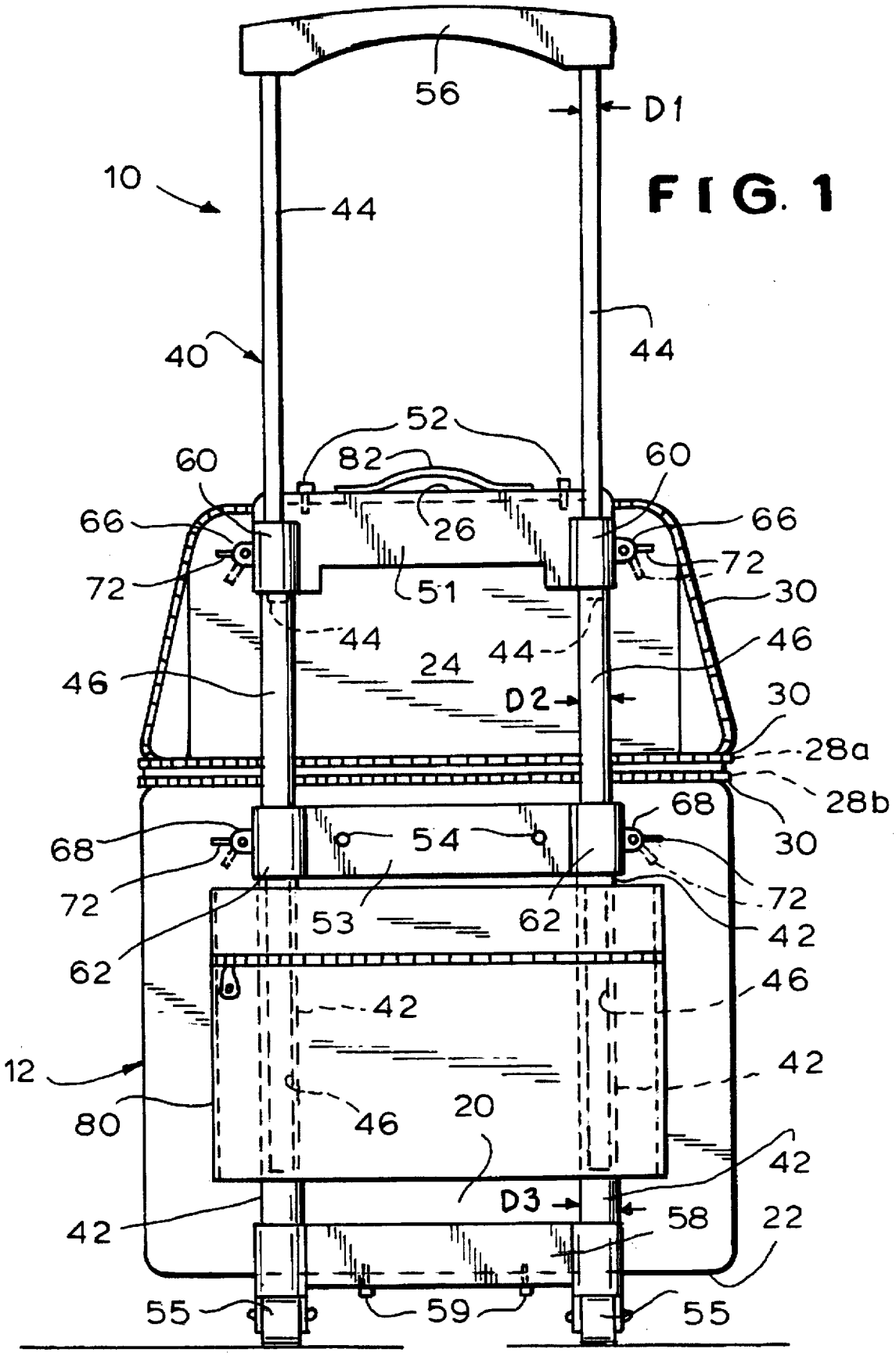
FIG. 1 is a front elevational view of luggage according to the present invention, with each intermediate shell of the luggage being in a vertically collapsed orientation.
Figure 2:
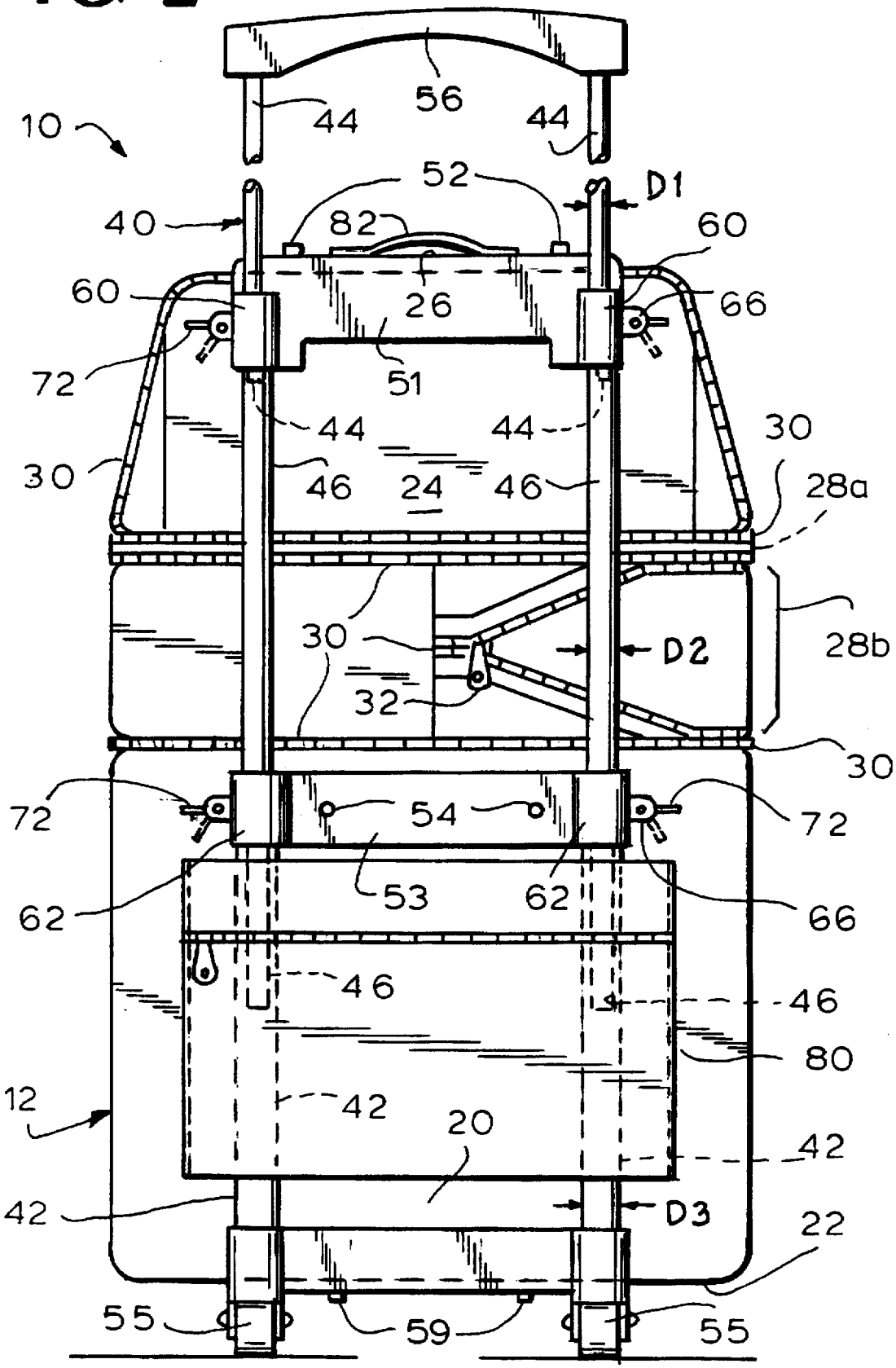
FIG. 2 is a view similar to FIG. 1, but with one intermediate shell of the luggage being in a vertically expanded orientation.
Figure 3:
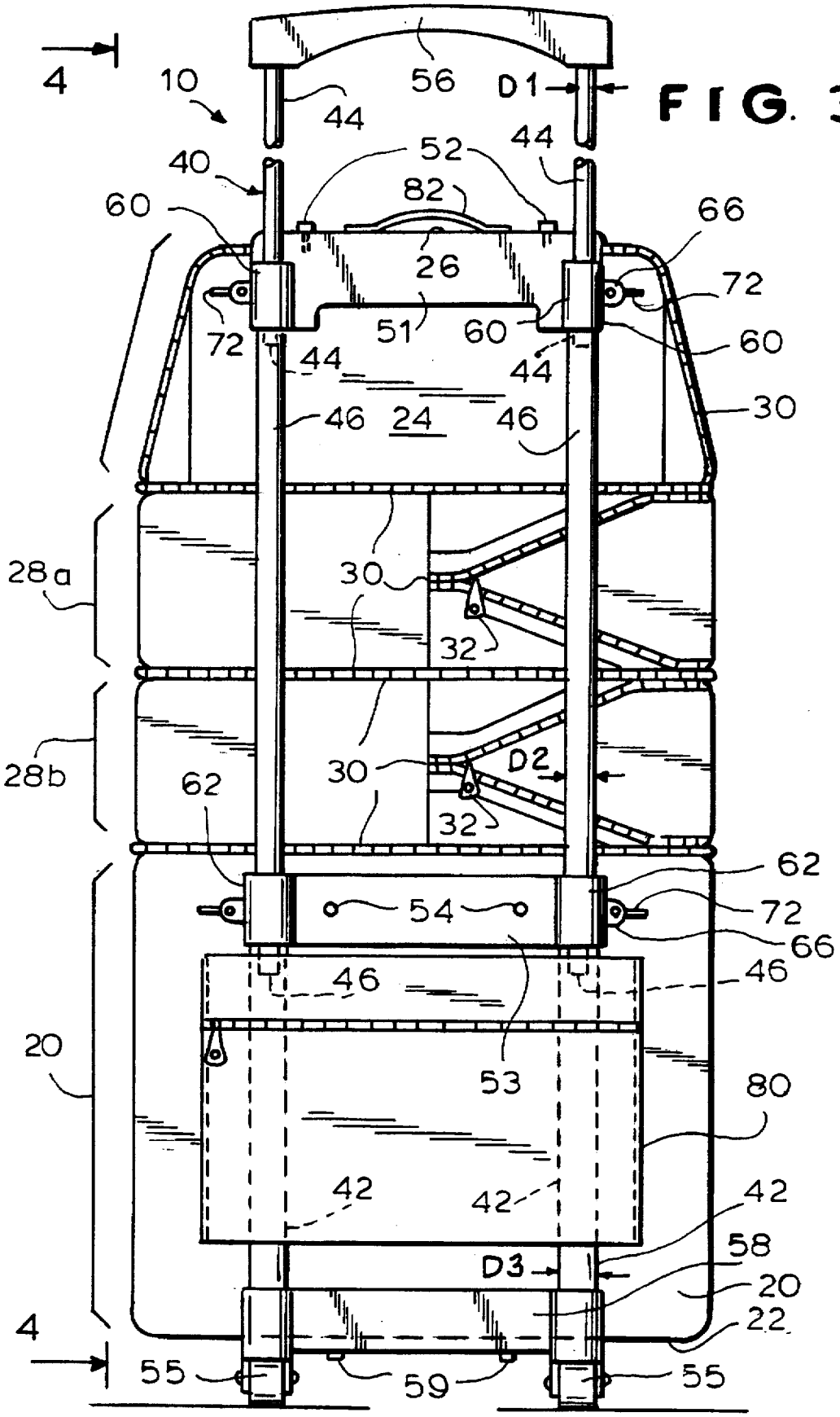
FIG. 3 is a view similar to FIG. 2, but with all of the intermediate shells of the luggage being in a vertically expanded orientation.

Referring now to the drawing, and in particular to FIGS. 1–3 thereof, therein illustrated is vertically expandable luggage according to the present invention, generally designated by the reference numeral 10.

In its conventional aspects, the vertically expandable luggage 10 comprises a vertically expandable luggage sidewall, generally designated 12, including at least three vertically stacked shells. The vertically stacked shells define a bottom shell 20 with a closed bottom 22, a top shell 24 with an openable closed top 26 (for example, a top 26 having a zipper opening), and at least one vertically stacked intermediate shell 28 connecting the bottom of the top shell 24 and the top of the bottom shell 20. As illustrated, there are two vertically stacked intermediate shells 28A and 28B.

At least one, and preferably each, of the intermediate shells 28A, 28B is movable between a vertically collapsed orientation (as illustrated in FIG. 1) and a vertically expanded orientation (as illustrated in FIG. 3). Preferably, the top and bottom of each expandable intermediate shell 28 are connected together by a zipper 30 accessible from outside the shell. When the zipper 30 is in the open orientation, the intermediate shell 28 is in or movable to the vertically expanded orientation. When the zipper is in the closed orientation the intermediate shell 28 is in the vertically collapsed orientation. The zipper 30 is movable between orientations by movement of the zipper pull tag 32, preferably 360° about the intermediate shell 28. As will be apparent to those familiar with the vertically expandable luggage art, other means may be employed for moving the intermediate shells 28 between vertically collapsed and expanded orientations.

To use the vertically expandable luggage, the user simply begins to fill the luggage sidewall 12 through the opened top 26 thereof. As it appears that additional intermediate shells 28 will be required to accommodate all of the user's belongings being taken, successive intermediate shells 28 are moved from the vertically collapsed orientation to the vertically expanded orientation. FIG. 2 illustrates the luggage with only the bottom intermediate shell **28*b* in the expanded orientation. When the bottom shell 20, the intermediate shells 28 and the top shell 24 are filled, the top 26 of the top shell 24** is closed.

Still referring now to FIG. 1 in particular, in its novel aspects the luggage 10 according to the present invention also comprises a vertically expandable wheeled carrier, generally designated 40. The carrier 40 includes at least three vertically stacked supports defining a bottom support 42 of diameter D3, a top support 44 of diameter D1, and a vertically stacked intermediate support 46 of diameter D2 functionally connecting the top support 44 and the bottom support 42. Functionally, the intermediate support 46 telescopically receives the top support 44 and in turn is telescopically received in the bottom support 42. Thus, diameter D2 is greater than diameter D1 and less than diameter D3.

The top support 44 is telescopically extendable from or receivable within the intermediate support 46 without any movement therewith of the luggage sidewall 12 or any portion 20, 24, 28 thereof. On the other hand, a top portion of the intermediate support 46 is secured to the top shell 24 (as illustrated by a rigid plate 51 and bolts 52) for vertical movement therewith, and the top portion of the bottom support 42 is secured to the bottom shell 20 (as illustrated by a rigid plate 53 and bolts 54) for vertical movement or non-movement therewith. Thus, while relative telescopic displacement of the intermediate support 46 (and plate 51) and bottom support 42 (and plate 53) is related to relative displacement of the top shell 24 and the bottom shell 20, relative telescopic displacement of the top support 44 and the intermediate support 46 is not related to relative displacement of the top shell 24 and the bottom shell 20.

The displacement of the top support 44 from the intermediate support 46 (compare FIGS. 1–3 and FIG. 4) is determined only by the need at a given time to have a handle 56 upstanding at a convenient height to facilitate movement of the luggage 10. By way of contrast, the relative displacement of the intermediate support 46 from the bottom support 42 is determined by the need to have the carrier expand or contract in conformity with the expansion or contraction of the overall luggage sidewall 12 (and in particular the expandable intermediate shells 28).

In other words, the telescopic action of the intermediate and bottom supports 46, 42 is coordinated with and a function of the bag size (i.e., the overall luggage sidewall height), while the telescopic action of the top and intermediate supports 44, 46 does not affect, and is not affected by, the bag size (i.e., the overall luggage sidewall height).

The carrier 40 additionally includes a wheel 55 at the base of each bottom support 42 to facilitate transport of the luggage 10. For transport purposes, the top support 44 is extended upwardly from the intermediate support 46 and the luggage 10 is tilted back on the wheel 55 using the top support 44 for balancing. The luggage 10 then be moved by the top support 44 either forwardly or rearwardly.

As illustrated, the present invention has one pair each of the three supports 42, 44, 46, with the two top supports 44 being connected at the top by a horizontally-extending rigid member 56 which serves as a handle to facilitate wheeling of the luggage 10, the two intermediate supports 46 being connected at the top by the L-shaped horizontally-extending rigid plate 51, and the two bottom supports 42 being connected at the top by the L-shaped horizontally-extending rigid plate 53. For further rigidity of the carrier structure, the bottom supports 42 are preferably also connected adjacent the bottom by the horizontally-extending rigid plate 58 bolted to the bottom 22 of the bottom shell 20 by bolts 59.

In a preferred embodiment of the present invention, top raceway connecting means 60 are disposed about and telescopically connect the top support 44 and the intermediate support 46 for telescopic action therebetween, while bottom raceway connecting means 62 are disposed about and telescopically connect the intermediate support 46 and the bottom support 42 for telescopic action therebetween. More particularly, the hollow raceway connecting means 60, 62 are secured fixedly about and to the large diameter support (that is, the intermediate support 46 in the case of the top raceway connecting means 60 and the bottom support 42 the case of the bottom raceway connecting means 62), while still allowing telescopic movement of the relatively smaller diameter support into the large diameter support. (While the description above assumes that the supports are cylindrical or circular in configuration, clearly other matching configurations for the telescopic supports may be employed.)

Figure 4:
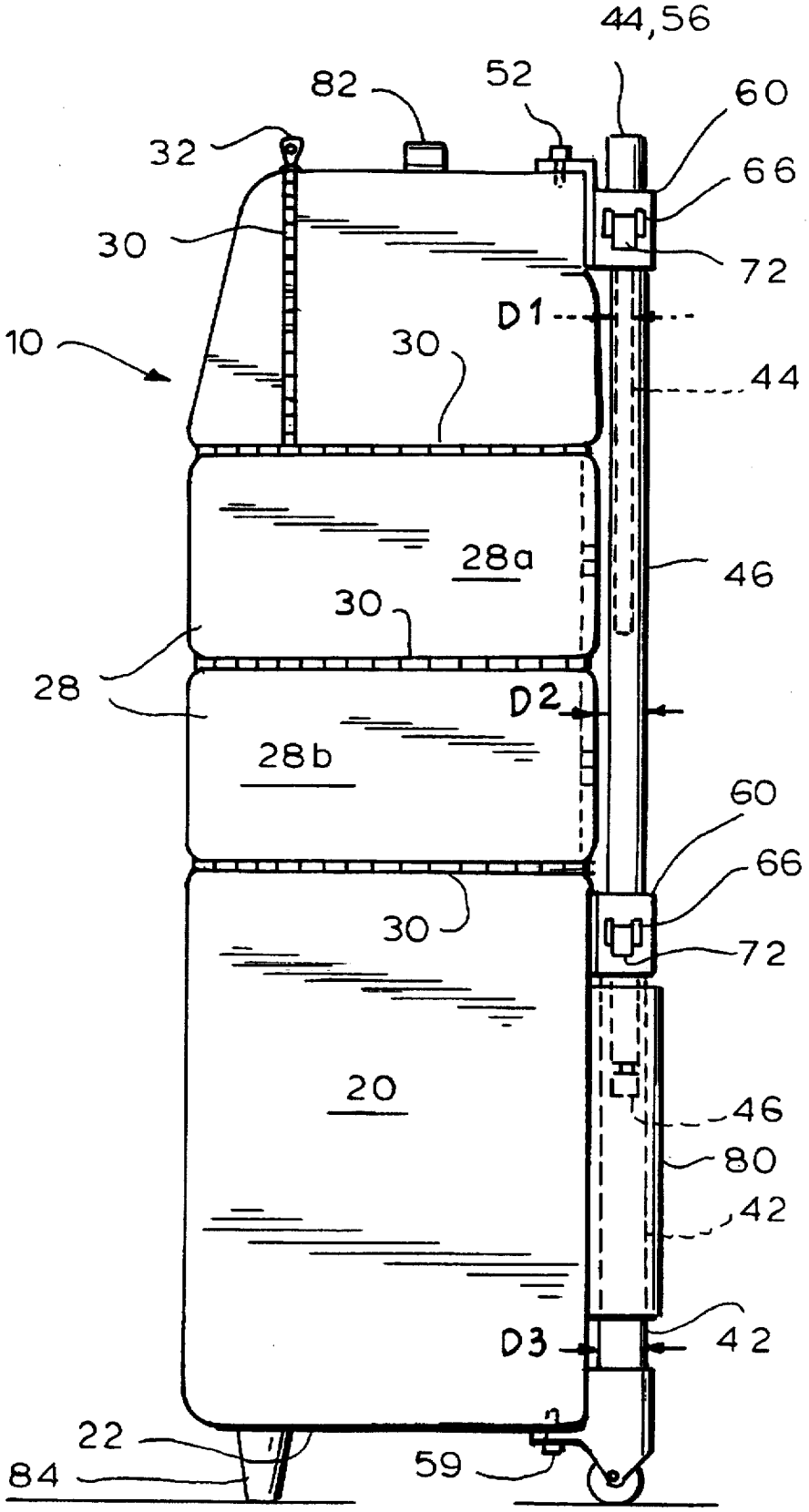
FIG. 4 is a side elevational view taken along the line 4—4 of FIG. 3.

Preferably, top locking means 66 are associated with the top raceway connecting means 60 for releasably precluding relative vertical movement of the top support 44 and the intermediate support 46, while bottom locking means 68 are associated with the bottom raceway connecting means 62 for releasably precluding relative vertical movement of the intermediate support 46 and the bottom support 42. To provide the locking means 66, 68, the upper portion of each raceway connecting means is apertured and provided with both a floating member (not shown) and a pivotable rocker lever 72. When the rocking lever 72 is in an enabling orientation (as illustrated in FIGS. 1—3), it exerts no pressure on the floating member, thereby allowing telescopic action to occur. On the other hand, when the rocker lever 72 is in a precluding orientation (as illustrated in FIG. 4), it firmly presses the floating member against the support of smaller diameter, thereby precluding telescopic action.

Raceway connecting means (enabling telescopic action between connected supports) and the locking means associated therewith (in the form of rocker clamps) are well known in the expandable carrier art and thus need not be described herein in any further detail. Of course, while the use of raceway connecting means and the locking means associated therewith are typical of more expensive luggage, simple frictional engagements (such as friction or jammer clamps) between telescopic supports may be used for less expensive luggage.

Optionally a zippered bag 80 may extend from adjacent one side of the bottom shell 20, across the bottom supports 42 (on the side opposite the bottom shell 20) to adjacent the other side of the bottom shell 20. This optional bag 80 not only increases the storage capacity of the luggage 10 but also conceals to some degree the bottom supports 42. A strap 82 may be mounted on the top of the top shell 24 to facilitate movement of the luggage sidewall 12 from the orientation in which at least one of the intermediate shells 28A, 28B is in the vertically collapsed orientation to one in which the collapsed intermediate shell is moved to its vertically expanded orientation. A pair of blocks 84 (best seen in FIG. 4) and secured to the bottom 22 of the bottom shell 20 adjacent the front thereof to maintain (in cooperation with the wheels 55) the luggage sidewall 12 in a generally vertically orientation when the bag is at rest.

To summarize, the present invention provides vertically expandable luggage which includes an integral wheeled carrier therefor, the carrier being vertically expandable so that the vertical height of the carrier is adjustable to match the vertical height of the luggage sidewall. The integral wheeled carrier is part of the vertically expandable luggage and allows the user to easily trasport the luggage (for example, in an airport or on a street) without the need to attach and detach the carrier. The luggage is inexpensive and easy to use.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. Vertically expandable luggage including a vertically expandable wheeled carrier therefor, comprising:

(A) a vertically expandable luggage sidewall including at least three vertically stacked shells defining:
(i) a bottom shell with a closed bottom,
(ii) a top shell with an openable closed top, and
(iii) at least one vertically stacked intermediate shell with flexible sidewalls connecting said top shell and said bottom shell, said at least one intermediate shell being movable between a vertically collapsed orientation and a vertically expanded orientation; and (B) a vertically expandable wheeled carrier including at least three vertically stacked supports defining:
(i) a bottom support of diameter D3;
(ii) a top support of diameter D1, and
(iii) a vertically stacked intermediate support of diameter D2 functionally connecting said top support and said bottom support, said intermediate support including means telescopically receiving said top support and means telescopically received in said bottom support said top support including means telescopically extendable from or receivable within said intermediate support without movement therewith of said luggage sidewall, a top portion of said intermediate support being secured to said top shell for vertical movement therewith, and a top portion of said bottom support being secured to said bottom shell for vertical movement therewith.

2. The luggage of claim 1 wherein relative telescopic displacement of said intermediate support and said bottom support is related to relative displacement of said top shell and said bottom shell.

3. The luggage of claim 1 wherein relative telescopic displacement of said top support and said intermediate support is not related to relative displacement of said top shell and said bottom shell.

4. The luggage of claim 1 additionally including top raceway connecting means about and connecting said top support and said intermediate support, and bottom raceway connecting means about and connecting said intermediate support and said bottom support.

5. The luggage of claim 4 additionally including top locking means associated with said top raceway connecting means for releasably precluding relative vertical movement of said top support and said intermediate support, and bottom locking means associated with said bottom raceway connecting means for releasably precluding relative vertical movement of said intermediate support and said bottom support.

6. The luggage of claim 1 wherein D2 is greater than D1 and less than D3.

7. The luggage of claim 1 including at least two vertically stacked intermediate shells.

8. Vertically expandable luggage including a vertically expandable wheeled carrier therefor, comprising:

(A) a vertically expandable luggage sidewall including at least three vertically stacked shells defining:
(i) a bottom shell with a closed bottom,
(ii) a top shell with an openable closed top, and
(iii) at least two vertically stacked intermediate shells with flexible sidewalls connecting said top shell and said bottom shell, each said intermediate shell being movable between a vertically collapsed orientation and a vertically expanded orientation;

(B) a vertically expandable wheeled carrier including at least three vertically stacked supports defining:
(i) a bottom support of diameter D3;
(ii) a top support of diameter D1, and
(iii) a vertically stacked intermediate support of diameter D2 functionally connecting said top support and said bottom support, said intermediate support including means telescopically receiving said top support and means telescopically received in said bottom support;

said top support including means telescopically extendable from or receivable within said intermediate support without movement therewith of said luggage sidewall, a top portion of said intermediate support being secured to said top shell for vertical movement therewith, and a top portion of said bottom support being secured to said bottom shell for vertical movement therewith such that relative telescopic displacement of said intermediate support and said bottom support is related to relative displacement of said top shell and said bottom shell, and relative telescopic displacement of said top support and said intermediate support is not related to relative displacement of said top shell and said bottom shell;

D2 being greater than D1 and less than D3; and (C) a releasable locking system including:
(i) top raceway connecting means about and connecting said top support and said intermediate support, said top raceway connecting means including top locking means for releasably precluding relative vertical movement of said top support and said intermediate support, and
(ii) bottom raceway connecting means about and connecting said intermediate support and said bottom support, said bottom raceway connecting means including bottom locking means for releasably precluding relative vertical movement of said intermediate support and said bottom support.

* * * * *